US011305857B1

(12) United States Patent
Jaeger et al.

(10) Patent No.: US 11,305,857 B1
(45) Date of Patent: Apr. 19, 2022

(54) OUTBOARD MOTOR WITH SOUND ABSORBING BLANKET

(71) Applicant: Brunswick Corporation, Mettawa, IL (US)

(72) Inventors: Matthew W. Jaeger, Oshkosh, WI (US); Timothy D. Krupp, Fond du Lac, WI (US); Kevin C. Kottke, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/009,184

(22) Filed: Sep. 1, 2020

(51) Int. Cl.
*B63H 20/32* (2006.01)
*F02B 61/04* (2006.01)

(52) U.S. Cl.
CPC ..... *B63H 20/32* (2013.01); *F02B 61/045* (2013.01)

(58) Field of Classification Search
CPC ..... B63H 20/32; F02B 61/045
See application file for complete search history.

(56) References Cited

U.S. PATENT DOCUMENTS 2,519,160 A * 8/1950 Tucker ..... G10K 11/161 181/203
3,599,594 A 8/1971 Taipale
3,961,595 A 6/1976 Meyer
4,669,698 A 6/1987 McGuire
5,238,433 A 8/1993 Hayasaka
6,146,220 A 11/2000 Alby et al.
6,419,534 B1 7/2002 Helsel et al.
6,419,537 B1 7/2002 House et al.
6,454,620 B1 9/2002 Theisen et al.
6,656,003 B1 12/2003 Kitsu et al.
6,848,411 B2 2/2005 Koyama
6,875,066 B2 * 4/2005 Wolaver ..... F01N 1/24 181/204
7,244,152 B1 7/2007 Uppgard
7,485,019 B1 2/2009 Macier et al.
7,896,304 B1 3/2011 Eichinger et al.
8,820,701 B1 9/2014 Eichinger
9,205,906 B1 12/2015 Eichinger
9,376,191 B1 6/2016 Jaszewski
9,446,828 B1 9/2016 Groeschel et al.
9,475,560 B1 10/2016 Jaszewski et al.
9,481,439 B1 11/2016 Groeschel et al.
(Continued)

FOREIGN PATENT DOCUMENTS

WO WO-2015107371 A1 * 7/2015 ..... B60R 13/0838

*Primary Examiner* — Stephen P Avila
(74) *Attorney, Agent, or Firm* — Andrus Intellectual Property Law LLC

(57) ABSTRACT

A marine drive is provided. The marine drive includes a propulsion unit, a supporting cradle that couples the propulsion unit to a transom bracket for attachment to a marine vessel, and a cowling system that at least partially covers a portion of the propulsion unit and a portion of the supporting cradle. The cowling system includes upper, middle, and lower cowling components, and the middle and lower cowling components are separated by a dynamic gap. The marine drive further includes a sound blanket positioned between the supporting cradle and the middle and lower cowling components. The sound blanket is configured to span the dynamic gap and block sound that would otherwise emanate from the propulsion unit via the dynamic gap.

19 Claims, 4 Drawing Sheets

(56) References Cited

U.S. PATENT DOCUMENTS

| | | | |
|---|---|---|---|
| 9,623,948 | B1 | 4/2017 | Waldvogel et al. |
| 9,643,703 | B1 | 5/2017 | Eichinger |
| 9,701,383 | B1 | 7/2017 | Stuber et al. |
| 9,963,213 | B1 | 5/2018 | Jaszewski et al. |
| 9,969,475 | B1 | 5/2018 | Waisanen |
| 10,464,648 | B1 | 11/2019 | Amerling et al. |
| 2004/0211383 | A1 | 10/2004 | Koyama |
| 2019/0283853 | A1 | 9/2019 | Willard |
| 2020/0001959 | A1 | 1/2020 | Davis et al. |

* cited by examiner

OUTBOARD MOTOR WITH SOUND ABSORBING BLANKET

FIELD

The present disclosure relates to marine vessels and watercraft, and more particularly to systems and methods for dampening noise emitted by outboard motors.

BACKGROUND

U.S. Pat. No. 10,464,648 discloses a marine drive that has a propulsion unit, a supporting cradle, a resilient mount that couples the propulsion unit to the supporting cradle, a sound blocking member that extends across an internal gap between the propulsion unit and the supporting cradle, and a cowling system having upper and lower cowlings that cover at least a portion of the propulsion unit and lower cradle covers that cover at least a portion of the supporting cradle. The upper and lower cowlings are separated from the lower cradle covers by an external gap so that the upper and lower cowlings can move along with the propulsion unit and with respect to the supporting cradle and the cradle covers. The sound blocking member blocks the sound which otherwise would emanate from propulsion unit via the internal gap and then from the marine drive via the external gap.

U.S. Patent Application No. 2019/0283853 discloses a device and technique for reducing noise experienced by boat passengers from an outboard boat motor. The device may be implemented in the form of a cover that is adjacent to at least a portion of the boat motor. The cover includes one or more walls or surfaces that reflect or attenuate soundwaves. The cover may be attached to the boat motor and/or the boat. The cover may be integral with the boat motor and/or the boat. The cover may be attached to the boat via a hinge to permit the cover to be pivoted away from the boat motor. The materials used to construct the cover may be provided in layers that help to attenuate, absorb or reflect soundwaves.

U.S. Pat. No. 7,485,019 discloses an apparatus and method for silencing an engine. A silencer is disposed about a motor and is molded to substantially match at least one of a contour of the cover and a contour of the motor to silence noise transmitted from the motor.

U.S. Pat. No. 6,875,066 discloses sound insulation for an engine contained within an outer casing, the insulation made up from a minimal number of interlocking molded foam insulation pieces forming a substantially continuous shroud surrounding the operating parts of the engine and having an outer surface matching the inner shape of the outer casing and in contact therewith. Preferably the outer casing is used to generate the molds used to manufacture the molded sound insulation pieces, thereby providing a good surface fit between the outer insulation surface and the inner casing surface.

U.S. Pat. No. 6,419,537 discloses a water reservoir that is provided for use in conjunction with the engine of a marine propulsion system. The water reservoir is shaped to comprise two or more water containment cavities that can be located in positions which absorb heat from various heat producing components of the engine and, in addition, serve as sound barriers to attenuate noise emanating from the engine. The water reservoir is connected in fluid communication with the water pump of the marine propulsion system and in fluid communication with a cooling system of the engine.

Each of the above patents and patent applications is hereby incorporated herein by reference in its entirety.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to one implementation of the present disclosure, a marine drive includes a propulsion unit, a supporting cradle that couples the propulsion unit to a transom bracket for attachment to a marine vessel, and a cowling system that at least partially covers a portion of the propulsion unit and a portion of the supporting cradle. The cowling system includes upper, middle, and lower cowling components, and the middle and lower cowling components are separated by a dynamic gap. The marine drive further includes a sound blanket positioned between the supporting cradle and the middle and lower cowling components. The sound blanket is configured to span the dynamic gap and block sound that would otherwise emanate from the propulsion unit via the dynamic gap.

According to another implementation of the present disclosure, a marine drive includes a propulsion unit, a supporting cradle that couples the propulsion unit to a transom bracket for attachment to a marine vessel, and a cowling system that at least partially covers a portion of the propulsion unit and a portion of the supporting cradle. The marine drive further includes a sound blanket positioned between the supporting cradle and the cowling system that is configured to block sound emanating from the propulsion unit. The sound blanket includes a non-hygroscopic material having a non-woven fiber layer.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clearness and understanding. No unnecessary limitations are to be inferred therefrom beyond the requirement of the prior art because such terms are used for descriptive purposes only and are intended to be broadly construed.

Figure 1:
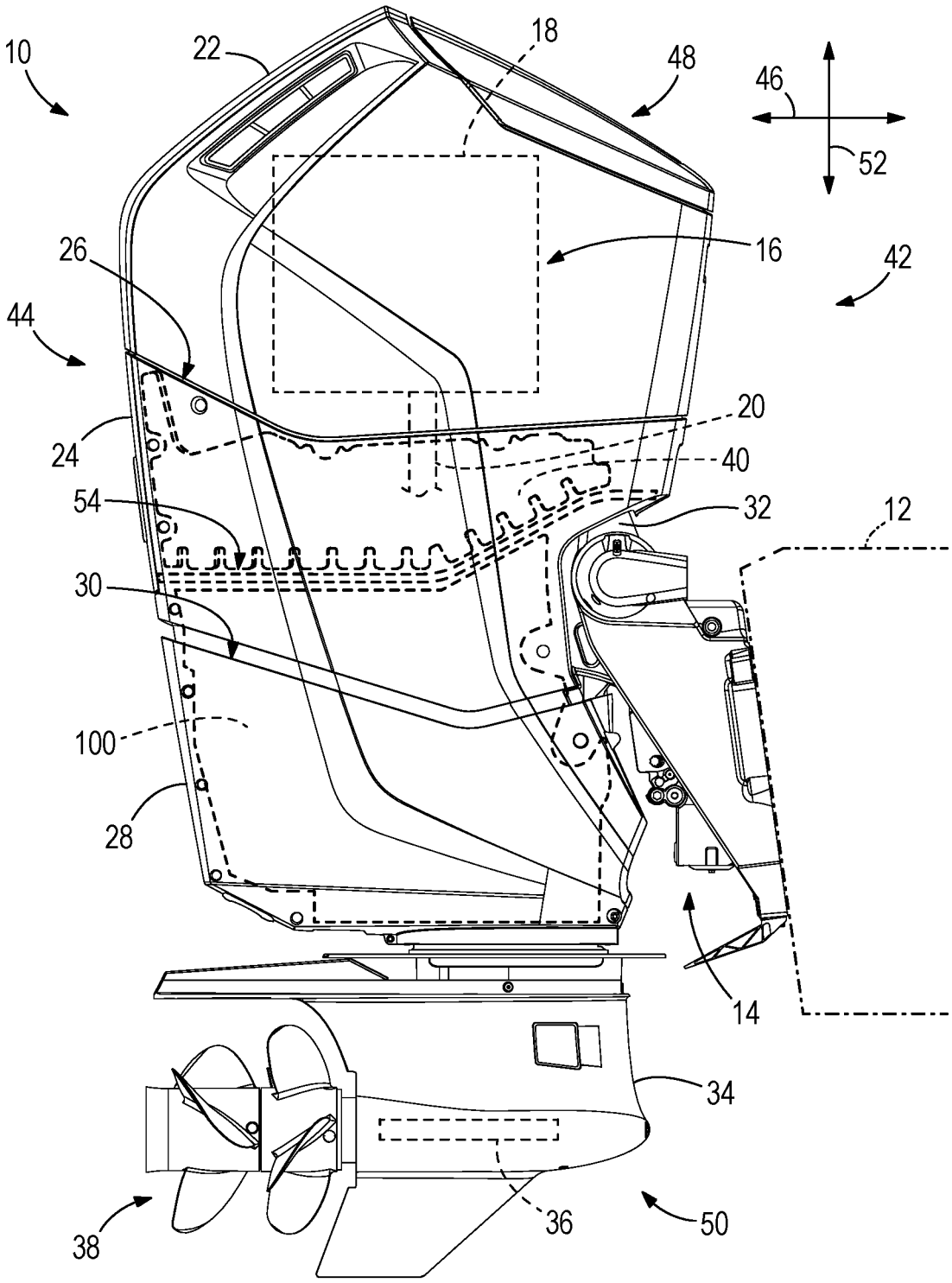
FIG. 1 is a side view of an outboard motor.

FIG. 1 depicts a starboard side view of an outboard motor or propulsion device 10 in accordance with an exemplary preferred embodiment of the present disclosure. In general, the outboard motor 10 extends between a forward side 42 and an aftward side 44 along a fore-aft axis 46, and between an upper side 48 and a lower side 50 along a vertical axis 52. Orthogonal to the fore-aft axis 46 and the vertical axis 52, the outboard motor 10 extends along a port-starboard axis. The outboard motor 10 is configured to be coupled to a transom 12 of a marine vessel via a transom bracket 14. A trim actuator may be coupled to the outboard motor 10 and the transom bracket 14 to trim the outboard motor 10 about a trim axis parallel to the port-starboard axis.

The outboard motor 10 is shown to include a cowling system with an upper cowling 22, mid cowling 24, and lower cowling 28. Each of the upper cowling 22, mid cowling 24, and lower cowling 28 may include one or more separate components that are coupled to each other. For example, the mid cowl 24 may include a port side component and a starboard side component. The upper cowling 22 covers a propulsion unit 16 including, for example, an internal combustion engine 18. The internal combustion engine 18 causes rotation of a generally vertically extending driveshaft 20. In an exemplary implementation, the engine 18 is supported by an isolation mounting cradle 32 that is coupled to the transom bracket 14. The isolation mounting cradle 32 may act to dampen vibrations induced by the engine 18 and other components to reduce the transmission of induced resonance and vibration running through the hull, cabin, and instruments of the marine vessel, resulting in quieter, more comfortable travel.

Rotation of the driveshaft 20 powers a propulsor 38 that is operably connected to the driveshaft 20 by a transmission gearset 36 that is located in a lower gearcase 34. In the illustrated example, the propulsor 38 includes multiple propellers. The type and configuration of the marine drive shown in the figures is for explanatory purposes only and a can vary from what is shown.

Still referring to FIG. 1, the upper cowling 22 is mated with the mid cowling 24 along a seam 26 and can be removed from the mid cowling 24 for access to the internal combustion engine 18. In an exemplary implementation, an engine compartment seal 54 is positioned below the seam 26. When the outboard motor 10 is operated in a body of water, the portions of the outboard motor 10 above the engine compartment seal 54 generally remain dry, while the portions of the outboard motor 10 below the seal 54 may be partially immersed or wetted. The mid and lower cowlings 24, 28 are separated by a dynamic gap 30. The dynamic gap 30 extends around the entire perimeter of the outboard motor 10 and is configured so that the mid and lower cowlings 24, 28 can move (e.g., vibrate, deflect, translate) with respect to each other and to the cradle 32, as will be further explained herein below.

During research and experimentation, the present inventors have determined that the dynamic gap 30 provides a pathway for sound emanating from the outboard motor 10. Prior outboard motor arrangements typically have a closed interior, defined by one continuous cowling or multiple cowling portions that are sealed with respect to each other, which retains sound emanating from the propulsion unit 16. However, unlike the prior art, the outboard motor 10 shown in FIG. 1 includes the dynamic gap 30 which extends around the perimeter of the outboard motor 10 and facilitates movement of the mid cowling 24 and lower cowling 28 with respect to the cradle 32. The dynamic gap 30 disadvantageously facilitates transmission of sound from the propulsion unit 16 to the outside of the cowling system and can be particularly disturbing to those people near the outboard motor 10, for example, occupants of the marine vessel. The present inventors have realized that this is a problem because in most situations it is desirable to maintain quiet operation of outboard motors. The present disclosure provides solutions to this problem.

The present inventors have further recognized that acoustic blocking materials previously utilized between propulsion units and cowling systems possess undesirable characteristics if used in generally wet regions within outboard motors. These acoustic blocking materials were generally selected from compliant semi-closed cell foams, for example polyvinyl chloride (PVC) nitrile butadiene rubber blended (NBR) foams. Semi-closed cell foams contain both open cells and closed cells. The presence of the open cells effectively dissipated sound energy, but left the foam material susceptible to water retention that degraded both the acoustical and the mechanical performance of the blocking material. In addition, the semi-closed cell foams were generally coupled to the cowling structure using adhesives. Adherence of the foams to the cowl pieces using adhesives limited the application to individual cowl pieces, which prevented the blocking materials from spanning gaps between the individual cowl pieces. As explained above, gap conditions facilitate the transmission of sound to the outside of the cowling system, resulting in noisier operation of outboard motors.

Thus, the present inventors have recognized that a semi-closed cell foam would not be suitable to acoustically block the transmission of sound from the dynamic gap 30 in the wetted region between the mid cowling 24 and the lower cowling 28, although a semi-closed cell acoustic blocker 40 may be utilized within the mid cowling 24 in the nominally dry region maintained above the engine compartment seal 54. Instead, the present inventors have provided a sound blanket 100 that spans the dynamic gap 30 as will be further explained herein below. The sound blanket 100 may be attached to the cradle 32 along an upper edge of the sound blanket 100 using multiple mechanical fasteners (e.g., bolts, screws, pins) rather than an adhesive. Advantageously, a lower edge of the sound blanket 100 proximate the lower gearcase 34 may remain free and unsecured to any component within the outboard motor 10. In this way, access to components of the outboard motor 10 behind the sound blanket 100 is permitted by merely lifting the lower edge of the sound blanket 100 upwards, without requiring removal of the sound blanket 100 from the cradle 32. This feature may therefore simplify servicing and troubleshooting operations of the outboard motor 10. In an exemplary implementation, the outboard motor 10 includes two identical sound blanket components 100, with a first sound blanket 100 installed on the port side of the cradle 32 and a second sound blanket 100 installed on the starboard side of the cradle 32. In other implementations, a single component sound blanket 100 may wrap around the cradle 32 and extend from the port side to the starboard side of the outboard motor 10.

Figure 2:
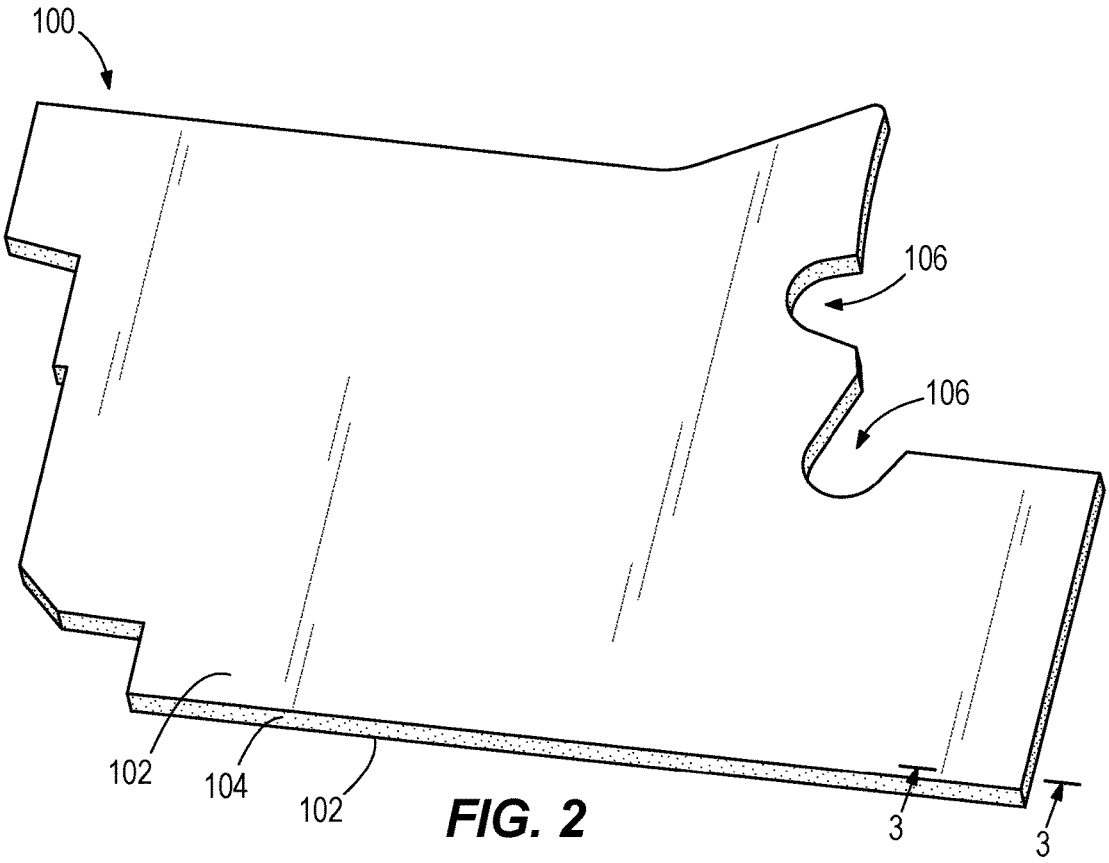
FIG. 2 is a perspective view of a sound blanket utilized in the outboard motor of FIG. 1.
Figure 3:
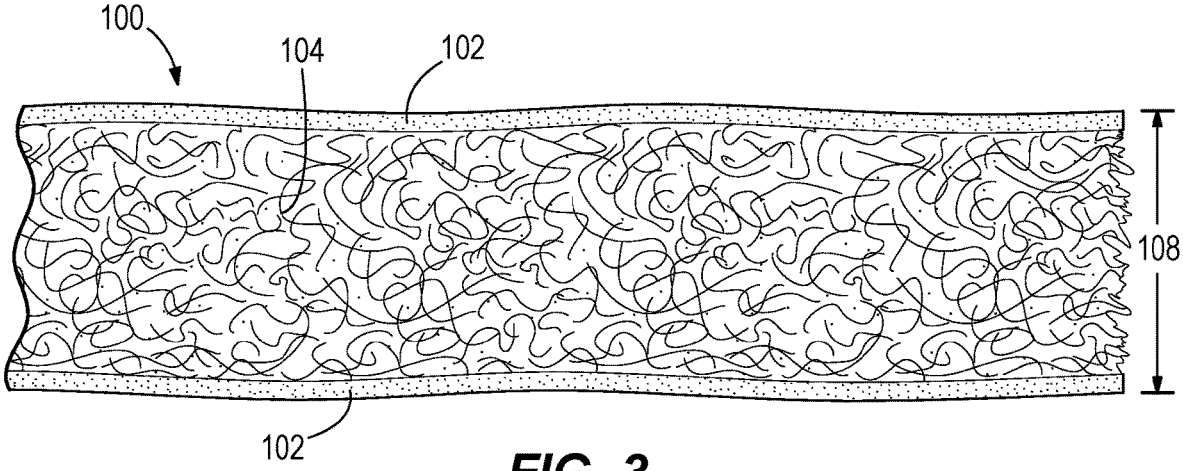
FIG. 3 is a side cross-sectional view of the sound blanket taken along the line 3-3 of FIG. 2.

Turning now to FIGS. 2 and 3, perspective and cross-sectional views of the sound blanket 100 are respectively depicted, according to an exemplary implementation. The sound blanket 100 is shown to include outer skin layers 102 that are coupled to a central fiber layer 104. The central fiber layer 104 may be comprised of extruded thermoplastic fibers that are arranged in a random manner and non-woven, similar to a filter material. In an exemplary implementation, the fibers are polyester, although a different fiber material (e.g., polypropylene) may be utilized. The fibers may contain recycled material, up to 100% post-consumer content. In an exemplary implementation, a fabric weight of the central fiber layer 104 ranges from 600 to 750 g/m$^2$, although in other implementations, the fabric weight of the central fiber layer 104 can be outside of this range. The fibers are bound together wherever they touch, thus providing a structure to the central fiber layer 104. Tests performed by the inventors indicated that unbound fibers become dislodged relative to each other and deteriorate rapidly in operation, thus leading to the selection of the bound fibers for the central fiber layer 104.

The outer skin layers 102 protect the integrity of the central fiber layer 104, and may be comprised of spunbound or woven polyester fabric. To avoid the use of adhesives to bond the skin and fiber layers 102, 104, the outer skin layers 102 may be coupled to the central fiber layer 104 using a flame lamination process. In an exemplary implementation, a fabric weight of each of the outer skin layers 102 ranges from 60 to 80 g/m$^2$, although in other implementations, the fabric weight of the outer skin layers 102 can be outside of this range.

In some implementations, one or both of the outer skin layers 102 and the central fiber layer 104 may incorporate an antifouling compound into the fibers or fabric to prevent the growth of bacterial slime, algae, barnacles, seaweed and other marine organisms. The antifouling compound may extend the lifespan of the sound blanket 100 by reducing the odor associated with unchecked biofouling when the outboard motor 10 is removed from a body of water. The antifouling agent may also minimize the damage to coatings and corrosion failures to components located behind the sound blanket 100 that might otherwise be caused by hard shell fouling from barnacle growth.

Advantageously, the sound blanket 100 is non-hygroscopic, meaning that it does not absorb or retain water. Although water may enter pores between the fibers in the central fiber layer 104 when the outboard motor 10 is submerged in a body of water, the water drains from the pores quickly when the outboard motor 10 is removed from the body of water without permanent damage to the acoustical or mechanical performance of the sound blanket 100. For example, upon removal of the outboard motor 10 from the body of water, the sound blanket 100 may be returned to a substantially pre-submergence condition within 90 minutes.

The outer perimeter of the sound blanket 100 may be cut to any shape required to fit within the outboard motor 10, for example, using a die cut or water jet process. The cut edges may be flame treated to seal the edges and allow for easier handling of the sound blanket 100. Although the outer perimeter of the sound blanket 100 may consist of generally straight edges, rounded clearance regions 106 may be provided to avoid interference between the sound blanket 100 and the mounting fasteners of the isolation cradle 32 and other components of the outboard motor 10. The sound blanket 100 may be readily compressible and conformable due to a low volumetric density and the presence of lofted fibers in the central fiber layer 104. Although the material is extended flat during the die cutting process, in installation the sound blanket 100 is wrapped around the midsection of the outboard motor 10 in a three-dimensional shape that may vary in thickness based on varying compressive forces exerted by other components of the outboard motor 10 on the sound blanket 100. In an exemplary embodiment, the thickness of the sound blanket 100 ranges from 20 to 30 mm, with a nominal thickness of 25 mm. In other implementations, the thickness of the sound blanket 100 ranges from 15 to 100 mm.

Figure 4:
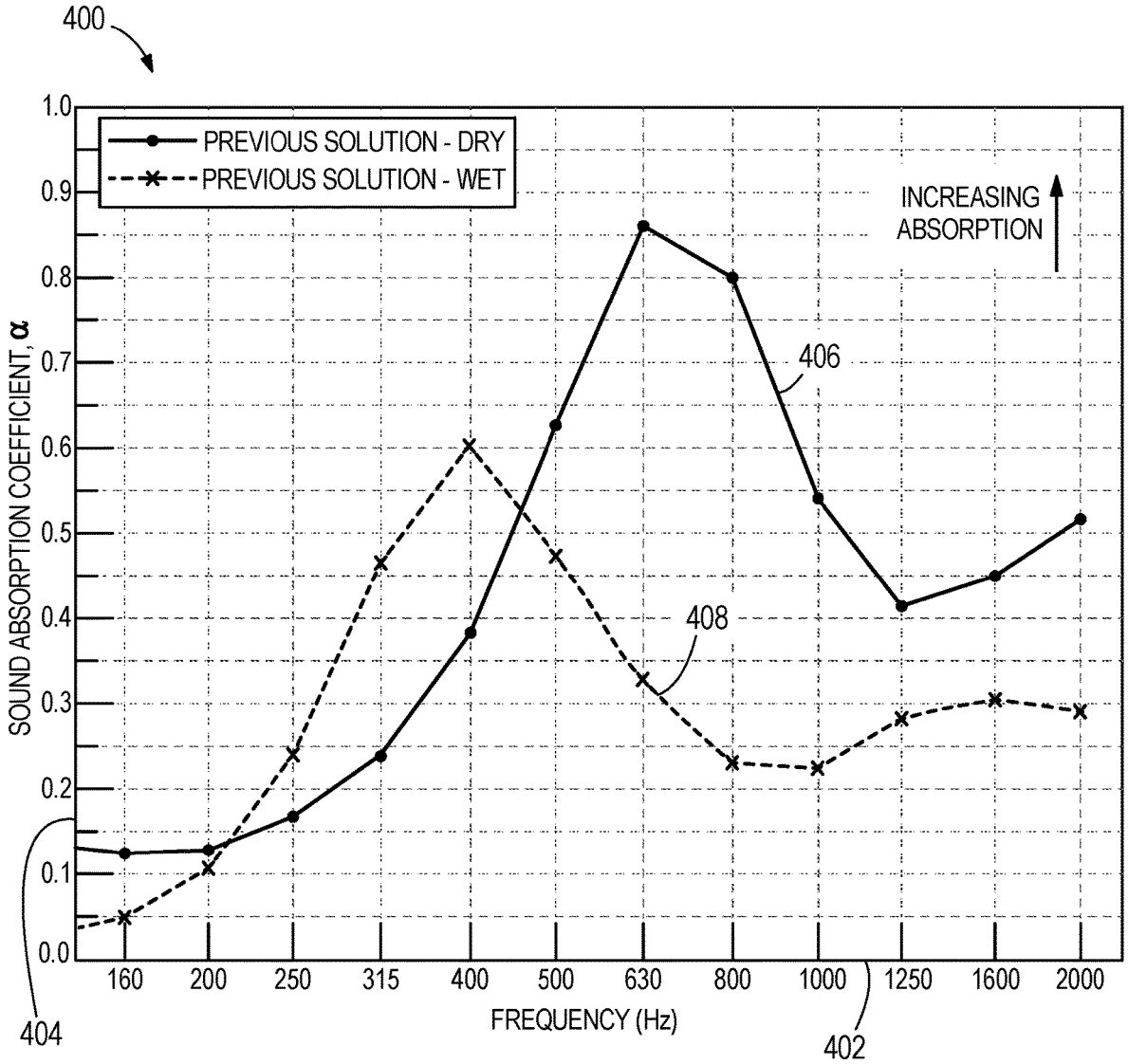
FIG. 4 is a plot depicting the acoustic absorption performance of a prior art sound blanket.
Figure 5:
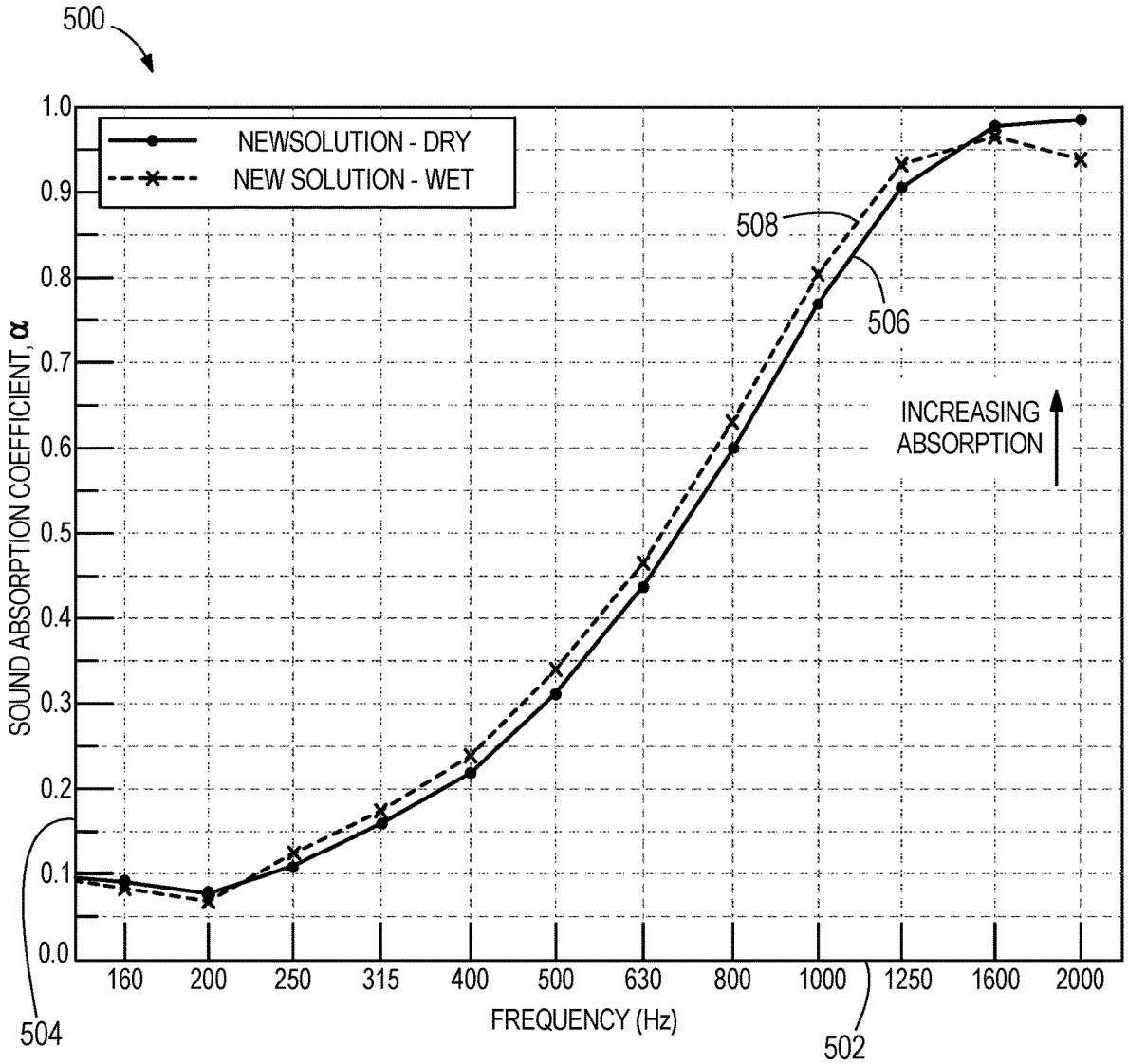
FIG. 5 is a plot depicting the acoustic absorption performance of the sound blanket of FIG. 2.

Referring now to FIGS. 4 and 5, sound absorption plots 400 and 500 illustrate the improved acoustic performance achieved by the present inventors. Specifically, plot 400 depicts the sound absorption performance of a semi-closed foam barrier used in prior outboard motor arrangements, while plot 500 depicts the sound absorption performance of the sound blanket of the present disclosure. The X-axes 402, 502 represent an acoustic frequency in units Hz, while the Y-axes 404, 504 depict a sound absorption coefficient, a, which represents a ratio of absorbed energy to incident energy. A coefficient value of 1.0 indicates a material that absorbs incident sound completely at a particular frequency, while a coefficient value of 0.5 would indicate 50% absorption and 50% reflection of incident sound.

As shown in FIG. 4, the performance of the semi-closed foam barrier under dry conditions (indicated by data line 406) generally increases with increasing sound frequency to a maximum sound absorption coefficient value of approximately 0.9 at 630 Hz. At higher frequencies, the absorption performance decreases up to frequencies of 1250 Hz, before increasing to an absorption coefficient value of approximately 0.5 at 2000 Hz. Under wet conditions (indicated by data line 408), the performance of the semi-closed foam barrier generally increases with increasing sound frequency to a maximum sound absorption coefficient value of approximately 0.6 at 400 Hz. At higher frequencies, the absorption performance decreases up to frequencies of 1000 Hz, before increasing to an absorption coefficient value of approximately 0.3 at 1600 Hz. Thus, the sound absorption performance of the semi-closed foam barrier under wet conditions is significantly reduced as compared with dry conditions.

By contrast, the sound absorption performance exhibited by the sound blanket 100 depicted in FIG. 5 remains comparably high under both wet and dry conditions. Under dry conditions (indicated by data line 506), the absorption performance of the sound blanket 100 generally increases with increasing sound frequency up to a maximum absorption coefficient value of 0.9 at 2000 Hz. Under wet conditions (indicated by data line 508), the absorption performance of the sound blanket 100 generally increases with increasing sound frequency up to a maximum absorption coefficient value of 0.9 at 1600 Hz, before declining slightly at 2000 Hz. The sound blanket 100 is therefore well-suited to dampen noise emitted from the outboard motor 10, particularly in the partially immersed or wetted regions of the outboard motor 10 located below the engine compartment seal 54 (depicted in FIG. 1).

In the present disclosure, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

What is claimed is:

1. A marine drive comprising:

a propulsion unit;

a supporting cradle that couples the propulsion unit to a transom bracket for attachment to a marine vessel;

a cowling system that at least partially covers a portion of the propulsion unit and a portion of the supporting cradle, the cowling system comprising upper, middle, and lower cowling components, wherein the middle and lower cowling components are separated by a dynamic gap;

a sound blanket positioned between the supporting cradle and the middle and lower cowling components, the sound blanket configured to span the dynamic gap and block sound that would otherwise emanate from the propulsion unit via the dynamic gap.

2. The marine drive of claim 1, wherein the sound blanket comprises a non-hygroscopic material.

3. The marine drive of claim 1, wherein the sound blanket comprises a fiber layer.

4. The marine drive of claim 3, wherein the fiber layer comprises up to 100% post-consumer content.

5. The marine drive of claim 3, wherein a fabric weight of the fiber layer ranges from 600 to 750 g/m$^2$.

6. The marine drive of claim 3, wherein the sound blanket further comprises an upper skin layer and a lower skin layer, wherein the fiber layer is positioned between the upper skin layer and the lower skin layer.

7. The marine drive of claim 6, wherein the upper skin layer and the lower skin layer are coupled to the fiber layer using a flame lamination process.

8. The marine drive of claim 6, wherein the upper skin layer, the fiber layer, and the lower skin layer each comprise polyester fibers.

9. The marine drive of claim 6, wherein a fabric weight of each of the upper skin layer and the lower skin layer ranges from 60 to 80 g/m$^2$.

10. The marine drive of claim 1, wherein a thickness of the sound blanket ranges from 20 to 30 mm.

11. The marine drive of claim 1, wherein the sound blanket is coupled to the supporting cradle without use of an adhesive.

12. The marine drive of claim 1, further comprising an engine compartment seal positioned within the cowling system, wherein a region above the engine compartment seal is substantially dry and wherein a region below the engine compartment seal is substantially wetted when the marine drive is in operation.

13. The marine drive of claim 12, further comprising an acoustic blocking member coupled to the middle cowling component in the substantially dry region above the engine compartment seal.

14. The marine drive of claim 13, wherein the acoustic blocking member is fabricated from a semi-closed cell foam.

15. The marine drive of claim 14, wherein the semi-closed cell foam is a polyvinyl chloride nitrile butadiene rubber blended foam.

16. A marine drive comprising:

a propulsion unit;

a supporting cradle that couples the propulsion unit to a transom bracket for attachment to a marine vessel;

a cowling system that at least partially covers a portion of the propulsion unit and a portion of the supporting cradle;

a sound blanket positioned between the supporting cradle and the cowling system and configured to block sound emanating from the propulsion unit, wherein the sound blanket comprises a non-hygroscopic material having a non-woven fiber layer; and wherein an upper portion of the sound blanket is coupled to the supporting cradle without use of an adhesive, and wherein a lower portion of the sound blanket is unsecured to any component of the marine drive.

17. The marine drive of claim 16, wherein the sound blanket comprises an antifouling compound.

18. A marine drive, comprising:

a propulsion unit;

a supporting cradle that couples the propulsion unit to a transom bracket for attachment to a marine vessel;

a cowling system that at least partially covers a portion of the propulsion unit and a portion of the supporting cradle;

a sound blanket positioned between the supporting cradle and the cowling system and configured to block sound emanating from the propulsion unit, wherein the sound blanket comprises a non-hygroscopic material having a non-woven fiber layer; and wherein the sound blanket is configured to be at least partially immersed in water when the marine drive is in operation in a body of water.

19. The marine drive of claim 16, wherein the cowling system comprises upper, middle, and lower cowling components, and wherein the sound blanket is positioned between the supporting cradle and the middle and lower cowling components.

* * * * *